US007762222B2

(12) United States Patent
Tanaka et al.

(10) Patent No.: US 7,762,222 B2
(45) **Date of Patent: *Jul. 27, 2010**

(54) VARIABLE VALVE TIMING CONTROLLER FOR INTERNAL COMBUSTION ENGINE

(75) Inventors: Toshikazu Tanaka, Kariya (JP); Masaomi Inoue, Kariya (JP); Yuuichi Takemura, Anjo (JP); Zenichiro Mashiki, Nissin (JP)

(73) Assignees: Denso Corporation, Kariya (JP); Toyota Jidosha Kabushiki Kaisha, Toyota (JP)

( * ) Notice: Subject to any disclaimer, the term of this patent is extended or adjusted under 35 U.S.C. 154(b) by 197 days.

This patent is subject to a terminal disclaimer.

(21) Appl. No.: 11/896,119

(22) Filed: Aug. 29, 2007

(65) Prior Publication Data

US 2008/0081702 A1 Apr. 3, 2008

(30) Foreign Application Priority Data

Aug. 30, 2006 (JP) ..... 2006-233281

(51) Int. Cl.
*F01L 1/34* (2006.01)

(52) U.S. Cl. ..... 123/90.17; 123/90.15; 123/90.31

(58) Field of Classification Search ..... 123/90.15, 123/90.16, 90.17
See application file for complete search history.

(56) References Cited

U.S. PATENT DOCUMENTS 7,059,285 B2 * 6/2006 Schafer et al. ..... 123/90.15
7,152,561 B2 12/2006 Schäfer et al.
7,353,789 B2 * 4/2008 Gregor et al. ..... 123/90.17
2005/0103298 A1 5/2005 Schafer et al.
2005/0201036 A1 * 9/2005 Santero et al. ..... 361/152
2006/0042579 A1 3/2006 Izumi et al.
2007/0056542 A1 3/2007 Gregor et al.

FOREIGN PATENT DOCUMENTS

DE 4110195 A1 10/1992

OTHER PUBLICATIONS

Extended Search Report dated Jan. 14, 2008 in EP Application No. 07115159.1.
U.S. Appl. No. 11/896,120, filed Aug. 2007, Tanaka et al.
Chinese Office Action dated Jan. 9, 2009 issued in corresponding Chinese Application No. 200710146263.3, with English translation.

* cited by examiner

*Primary Examiner*—Zelalem Eshete
(74) *Attorney, Agent, or Firm*—Nixon & Vanderhye P.C.

(57) ABSTRACT

A motor current (driving current of motor) is estimated based on a target motor speed, an actual motor speed, and an engine speed. When the estimated motor current exceeds the upper limit value equivalent to a heat generation limiting current, the motor current is restricted by restricting a variation (motor speed F/B amount) in target motor speed outputted to an EDU from an ECU. Thereby, the heat value of motor may not exceed the heat generation limit, and it can be prevented that the coil temperature of motor exceeds an allowable temperature range. A durability deterioration and failure of motor can be prevented.

14 Claims, 10 Drawing Sheets

VARIABLE VALVE TIMING CONTROLLER FOR INTERNAL COMBUSTION ENGINE

CROSS-REFERENCE TO RELATED APPLICATION

This application is based on Japanese Patent Application No. 2006-233281 filed on Aug. 30, 2006, the disclosure of which is incorporated herein by reference.

This application is also related to commonly assigned application Ser. No. 11/896,120 (now U.S. Pat. No. 7,584,729) filed Aug. 29, 2007.

FIELD OF THE INVENTION

The present invention relates to a variable valve timing controller which includes an electric motor as a driving source. A rotation speed of the electric motor is varied to adjust a rotational phase of the camshaft relative to a crankshaft, whereby a valve timing of an intake valve and/or an exhaust valve of an internal combustion engine is adjusted.

BACKGROUND OF THE INVENTION

In order to perform electronic control of the variable valve timing control, the variable valve timing controller which has the motor as a source of the drive has been developed. The variable valve timing controller described in JP-2006-70754A (US2006/0042578A1) includes a first gear, a second gear, a phase changing gear, and an electric motor. The first gear (outer gear) is concentrically arranged with the camshaft and is rotated with the rotation driving force of the crankshaft. The second gear (inner gear) rotates together with the camshaft. The phase changing gear (planet gear) transmits the torque of the first gear to the second gear, and varies the rotational phase of the second gear relative to the first gear. The motor is coaxially provided to the camshaft so that the revolution speed of the phase changing gear is controlled. The number of teeth of the first gear, the second gear, and the phase changing gear is determined so that the camshaft may rotate with one half of the rotational speed of the rotational speed of the crankshaft.

In the above motor drive variable valve timing controller, as a driving current of the motor ("motor current") increases during the variable valve timing control, the heat value of the motor increases and a coil temperature rises. When the transient operating condition in which a target motor speed (target valve timing) changes frequently continues, a coil temperature of the motor may exceed an allowable temperature and will cause durability deterioration and malfunction of the motor.

The present invention is made in view of the above matters, and it is an object of the present invention to provide a variable valve timing controller which adjusts valve timing by use of an electric motor and is able to restrict an excessive temperature rising of a motor coil.

SUMMARY OF THE INVENTION

According to the present invention, a variable valve timing controller adjusting a valve timing of an intake valve and/or an exhaust valve by varies a speed of an electric motor relative to a rotational speed of a camshaft in such a manner as to vary a camshaft phase representing a rotational phase of the camshaft relative to a crankshaft of an internal combustion engine. The controller includes a target motor speed computing means for computing a target motor speed based on a rotation speed of the internal combustion engine and a deviation between a target camshaft phase and an actual camshaft phase. The controller includes a motor drive control means for feedback controlling a motor current representing a driving current of the motor in such a manner as to decrease a deviation between the target motor speed and an actual motor speed. The controller includes a motor current estimating means for estimating the motor current, and a motor current restricting means for restricting the motor current when the motor current estimated by the motor current estimating means exceeds a predetermined value.

Hence, the heat value of motor may not exceed the heat generation limit, and it can be prevented that the coil temperature of motor exceeds the allowable temperature range. The durability deterioration and failure of motor can be prevented. In this case, when the motor current is restricted, the speed of response of the variable valve timing control becomes slow.

DETAILED DESCRIPTION OF THE PREFERRED EMBODIMENTS

Embodiments of the present invention will be described hereinafter.

First Embodiment

Referring to FIGS. 1 to 9, a first embodiment 1 of the present invention is described hereinafter.

Figure 1:
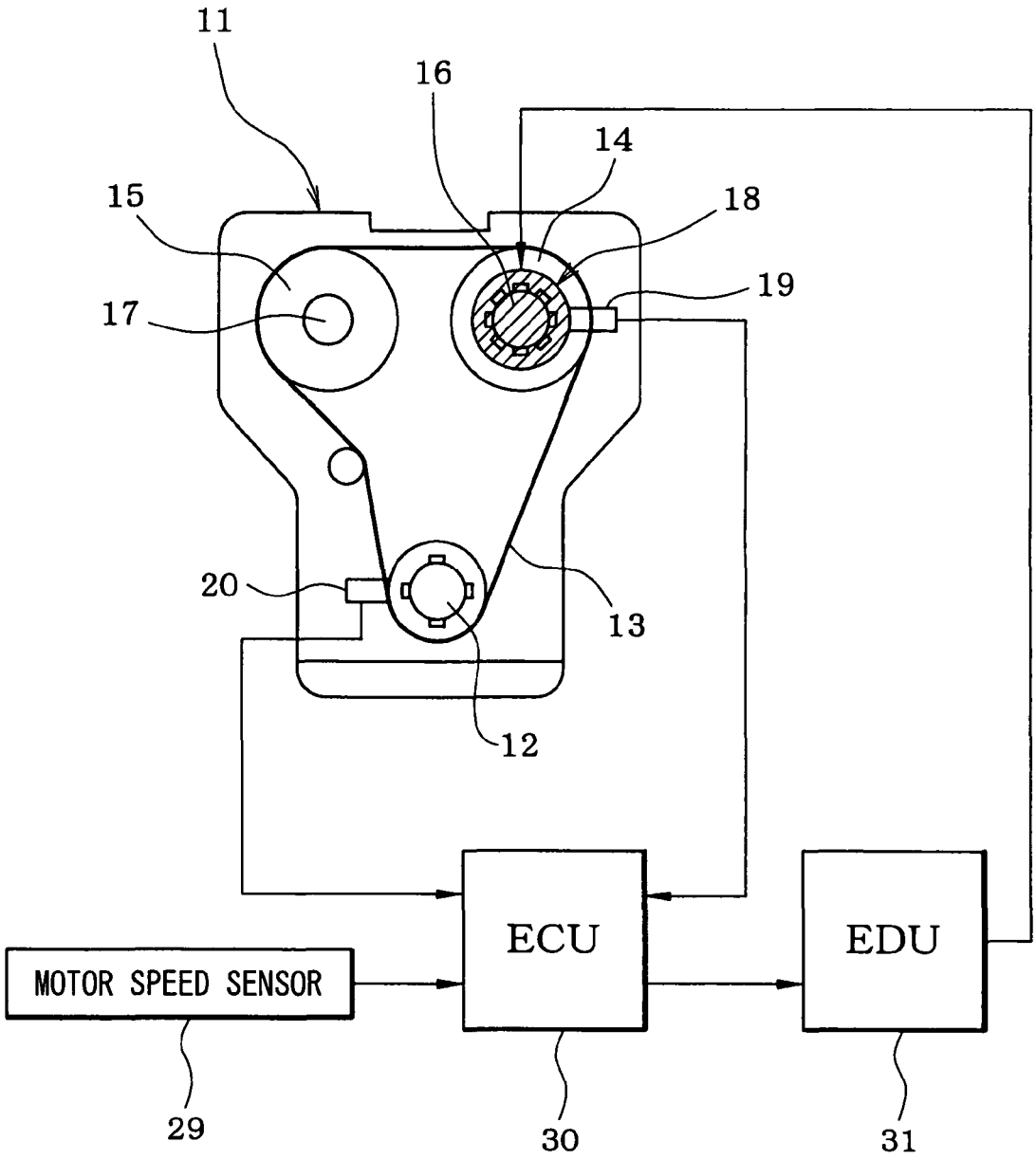
FIG. 1 is a schematic view showing an engine control system according to a first embodiment of the present invention.

FIG. 1 schematically shows a whole structure of an engine control system. An internal combustion engine 11, which is referred to as an engine hereinafter, includes a crankshaft 12. A driving force of the crankshaft 12 is transmitted to an intake camshaft 16 and an exhaust camshaft 17 through a timing chain 13 (or a timing belt) and sprockets 14, 15. A variable valve timing controller 18, which includes an electric motor, is coupled to the intake cam shaft 16. The variable valve timing controller 18 varies a rotational phase (camshaft phase) of the intake camshaft 16 relative to the crankshaft 12 so that the valve timing of an intake vale (not shown) is adjusted.

A cam angle sensor 19 is provided around the intake camshaft 16. The cam angle sensor 19 outputs a cam angle signal every predetermined cam angle of the intake camshaft 16. A crank angle sensor 20 is provided around the cranks shaft 12. The crank angle sensor 20 outputs a crank angle signal every predetermined crank angle.

Figure 2:
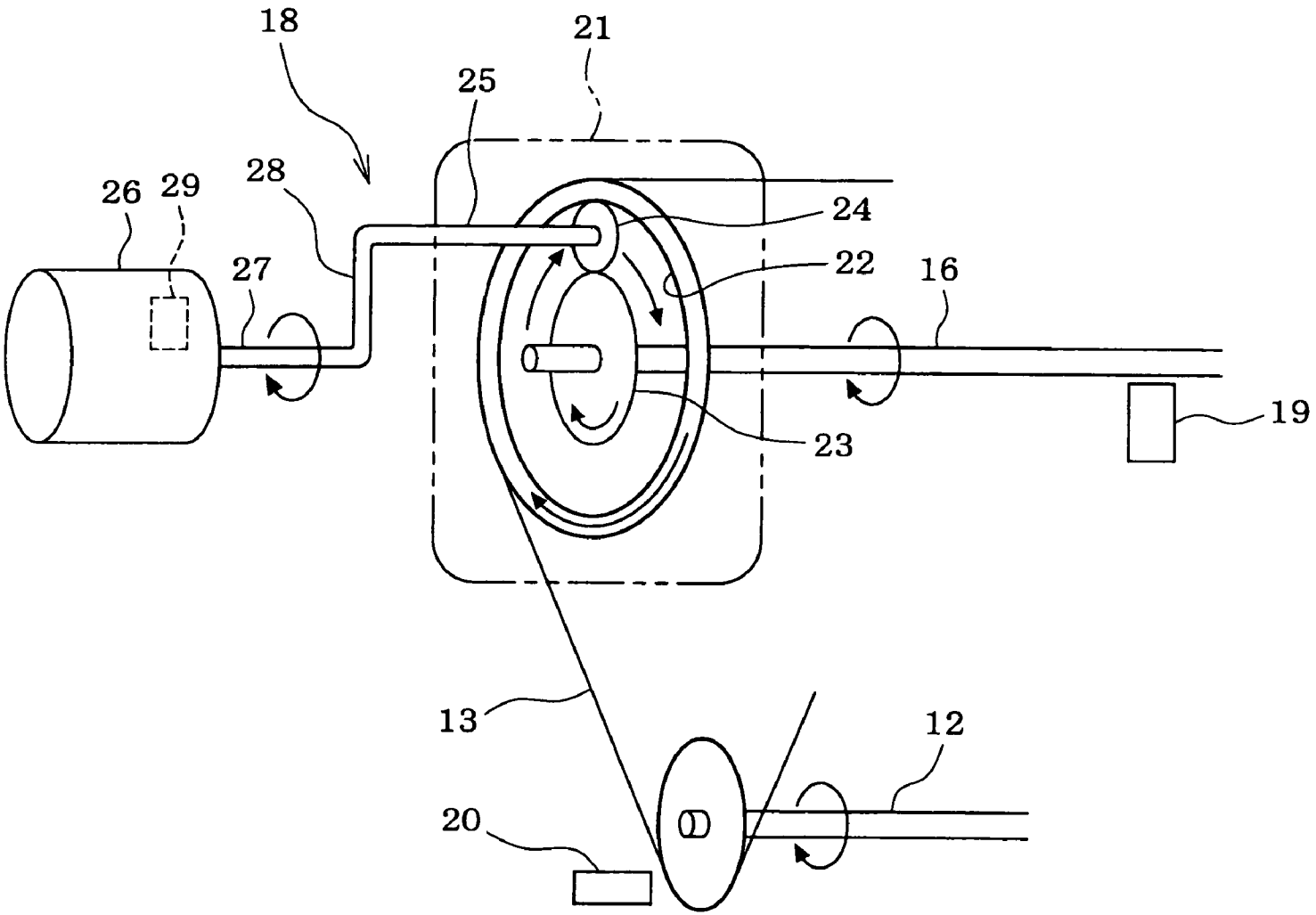
FIG. 2 is a schematic view showing a variable valve timing controller.

Referring to FIG. 2, a structure of the variable valve timing controller 18 is described.

The variable valve timing controller 18 includes a phase control mechanism 21. The phase control mechanism 21 includes an outer gear 22 (a first gear), an inner gear 23 (a second gear), and a planet gear 24 (a phase changing gear). The outer gear 22 is concentrically arranged with the intake camshaft 16 and has inner teeth. The inner gear 23 is concentrically arranged with the outer gear 22 and has outer teeth. The planet gear 24 is arranged between the outer gear 22 and the inner gear 23 to be engaged with both gears 22, 23. The outer gear 22 rotates integrally with the sprocket 14 which rotates in synchronization with the crankshaft 12, and the inner gear 23 rotates integrally with the intake camshaft 16. Engaging with the outer gear 22 and the inner gear 23, the planet gear 24 rotates around the inner gear 23 to transfer a rotation force from the outer gear 22 to the inner gear 23. A rotational phase of the inner gear 23 (camshaft phase) relative to the outer gar 22 is adjusted by varying a revolution speed of the planet gear 24 relative to the rotation speed of the inner gear 23. The number of teeth of the outer gear 22, the inner gear 23 and the planet gear 24 are determined in such a manner that the intake camshaft 16 rotates in a half speed of the crankshaft 12.

Rotational speed of the intake camshaft 16=Rotational speed of the crankshaft 12×½

The engine 11 is provided with a motor 26 which varies the revolution speed of the planet gear 24. A rotation shaft 27 of the motor 26 is concentrically arranged with the intake camshaft 16, the outer gear 22, and the inner gear 23. A connecting shaft 28 connects the rotation shaft 27 with a supporting shaft 25 of the planet gear 24. When the motor 26 is energized, the planet gear 24 rotates on the supporting shaft 25 and orbits around the inner gear 23. Besides, the motor 26 is provided with a motor speed sensor 29 which outputs a rotational motor speed signal.

When the motor 26 is not energized, the rotation shaft 27 rotates in synchronization with the intake camshaft 16. That is, when the rotation speed RM of the motor 26 is consistent with the rotation speed RC of the intake camshaft 16, and the revolution speed of the planet gear 24 is consistent with the rotational speed of the inner gear 23, a difference between a rotational phase of the outer gear 22 and a rotational phase of the inner gear 23 is maintained as a current difference to maintain the valve timing (camshaft phase) as the current valve timing.

When the rotation speed RM of the motor 26 is made higher than the rotational speed RC of the intake camshaft 16, that is, when the revolution speed of the planet gear 24 is made higher than the rotational speed of the inner gear 23, the rotational phase of the inner gear 23 relative to the outer gear 22 is advanced so that the valve timing of the intake valve is advanced. Thereby, the rotational phase of the inner gear 23 relative to the outer gear 22 is advanced, and the valve timing (camshaft phase) is advanced.

Meanwhile, When the rotation speed RM of the motor 26 is made lower than the rotational speed RC of the intake camshaft 16, that is, when the revolution speed of the planet gear 24 is made lower than the rotational speed of the inner gear 23, the rotational phase of the inner gear 23 relative to the outer gear 22 is retarded so that the valve timing of the intake valve is retarded.

The outputs of the sensors are inputted into an electronic control unit 30, which is referred to as an ECU 30 hereinafter. The ECU 30 includes a microcomputer which executes engine control programs stored in a ROM (read only memory) to control a fuel injection and an ignition timing according to an engine driving condition.

Figure 3:
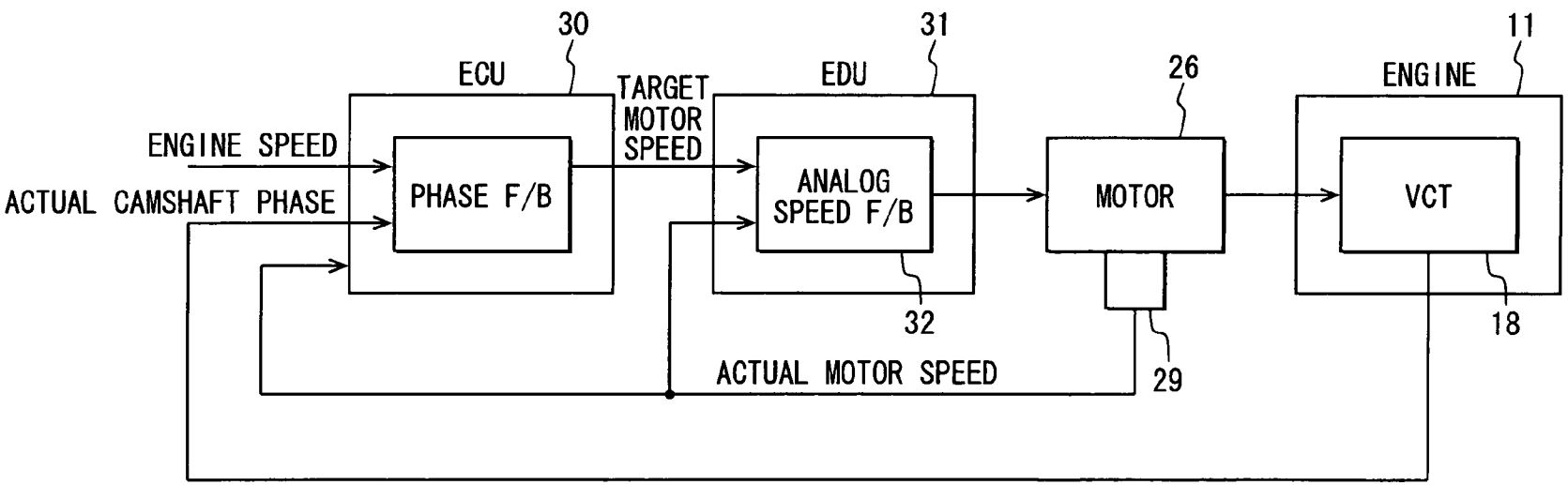
FIG. 3 is a block diagram showing the structure of the control system of the variable valve timing controller.

Moreover, the ECU 30 calculates a rotational phase (actual camshaft phase) of the camshaft 16 relative to the crankshaft 12 based on the output of the cam angle sensor 19 and the crank angle sensor 20. The ECU 30 calculates the target camshaft phase (target valve timing) according to an engine operating conditions. The ECU 30 calculates the target motor speed based on the engine speed and a deviation between the target camshaft phase and the actual camshaft phase. And as shown in FIG. 3, the ECU 30 outputs the signal indicative of the target motor speed toward the motor drive circuit (EDU) 31.

The EDU 31 performs a motor drive control. The EDU 31 has an analog rotating-speed feedback circuit 32 which performs feedback control of the duty of the voltage applied to the motor 26 so that the deviation of the target motor speed and an actual motor speed is decreased. The EDU 31 performs a feedback control of the actual motor speed to the target motor speed, and performs a feedback control of the actual camshaft phase to the target camshaft phase. "Feedback" is expressed as "F/B" in the following description.

Figure 4:
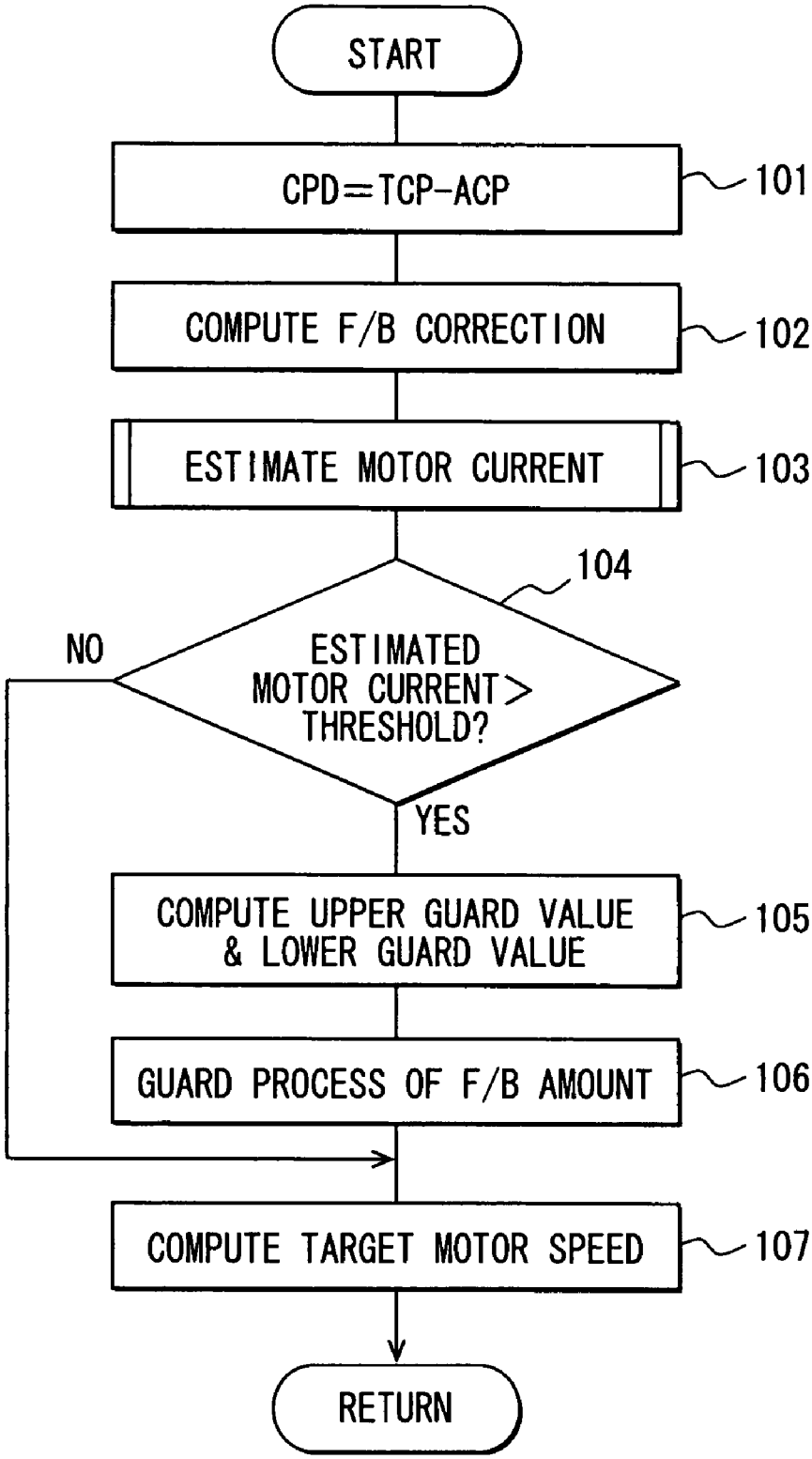
FIG. 4 is a flow chart showing a processing of the target motor speed operation program according to the first embodiment.
Figure 5:
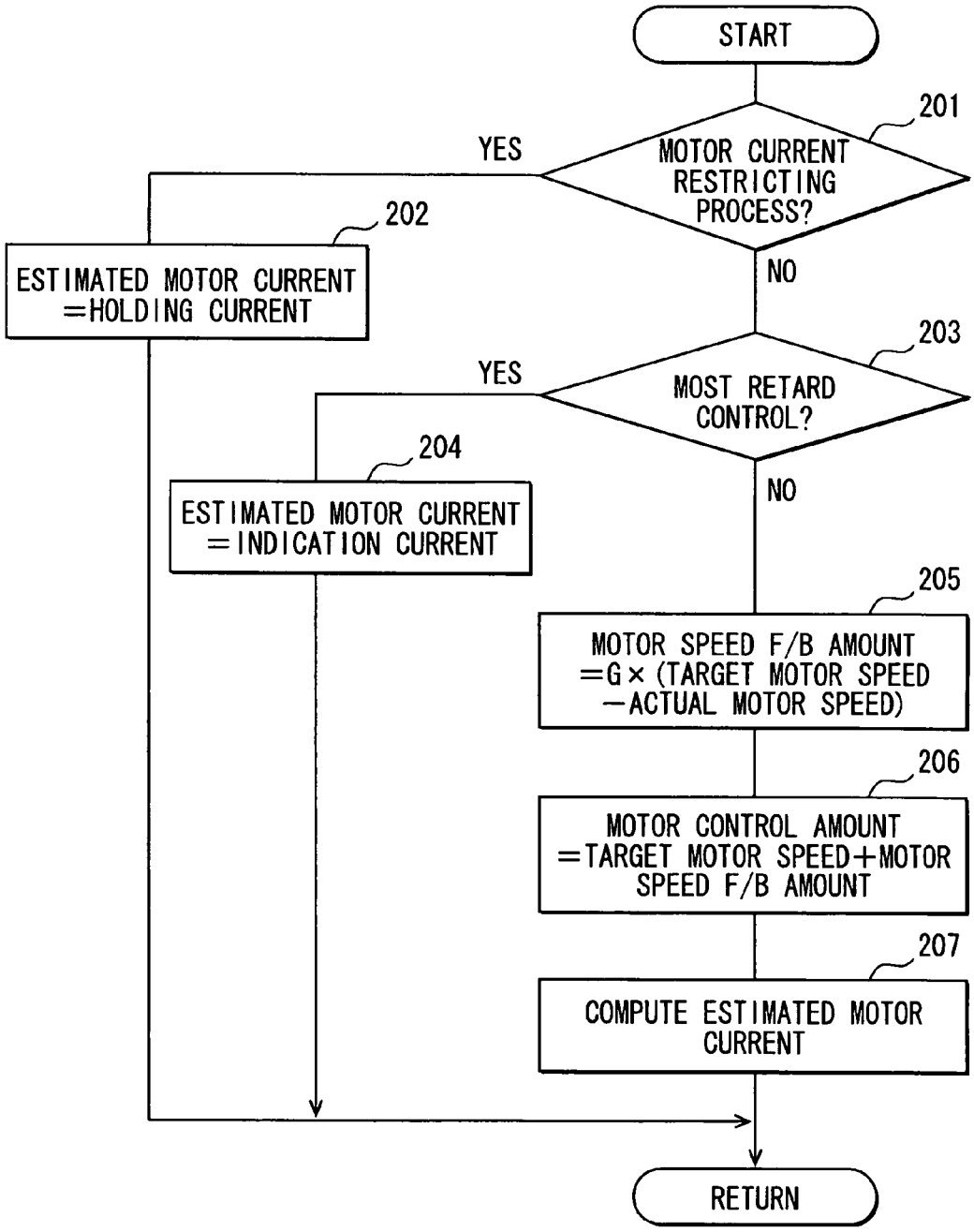
FIG. 5 is a flow chart showing a processing of the motor current estimation program according to the first embodiment.

The ECU 30 is executing each program shown in FIGS. 4 and 5 during the engine operation. A motor current (driving current of motor) is estimated based on a target motor speed, an actual motor speed, and an engine speed. When the estimated motor current exceeds the upper limit value equivalent to a heat generation limiting current, the ECU 30 restricts a variation in target motor speed to be outputted to the EDU 31. This variation corresponds to a motor speed F/B amount. Hereafter, the processing of each program of FIGS. 4 and 5 which the ECU 30 executes is explained.

[Target Motor Speed Computation Program]

The ECU 30 executes the target motor speed computation program shown in FIG. 4 during the engine operation.

In step 101, a deviation between the target camshaft phase and the actual camshaft phase is computed. This deviation is referred to as the camshaft phase deviation.

Camshaft phase deviation (CPD)=Target camshaft phase (TCP)−Actual camshaft phase (ACP)

Figure 6:
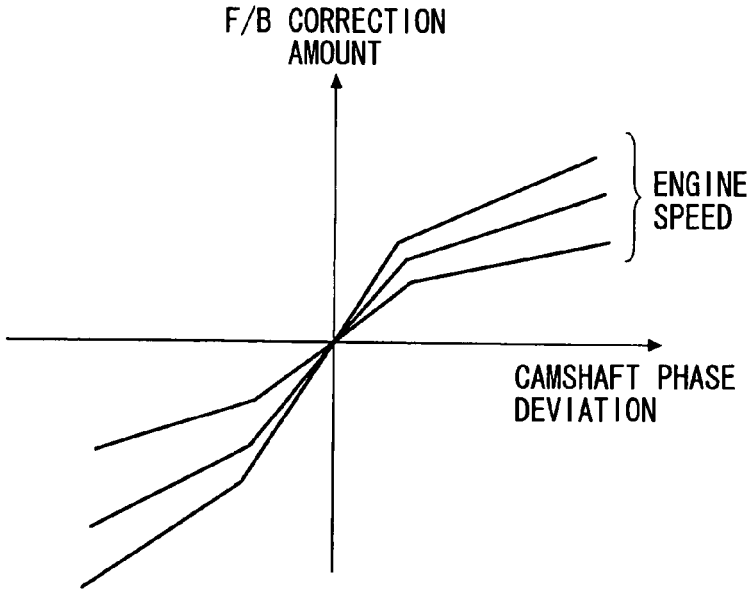
FIG. 6 is a chart schematically showing a motor speed F/B amount map.

Then, the procedure proceeds to step 102 in which the rotational speed F/B correction amount according to the present engine speed and the camshaft phase deviation is computed with reference to the rotational speed F/B correction amount map shown in FIG. 6. As shown in the motor speed F/B correction amount map of FIG. 6, as camshaft phase deviation (CPD) increases, the motor speed F/B correction amount increases, and as the engine speed increases, the motor speed F/B correction amount increases.

After computing the rotational speed F/B correction amount, the procedure proceeds to step 103 in which a motor current estimation program shown in FIG. 5 is executed. In step 103, the estimated motor current is computed based on the instant target motor speed and the instant actual motor speed. Then, the procedure proceeds to step 104 in which it is determined whether the estimated motor current exceeds a specified value (threshold) equivalent to the heat generation limiting current value. When the answer is No in step 104, the procedure proceeds to step 107 in which the target motor speed is established based on the following equation without restricting the motor speed F/B correction amount computed in step 102.

Target motor speed (TMS)=Base target motor speed (BTMS)+Motor speed *F/B* correction amount (MSFBC)

Here, the base target motor speed is the motor speed which is in agreement with the camshaft rotational speed (crankshaft rotation speed×½).

Figure 7:
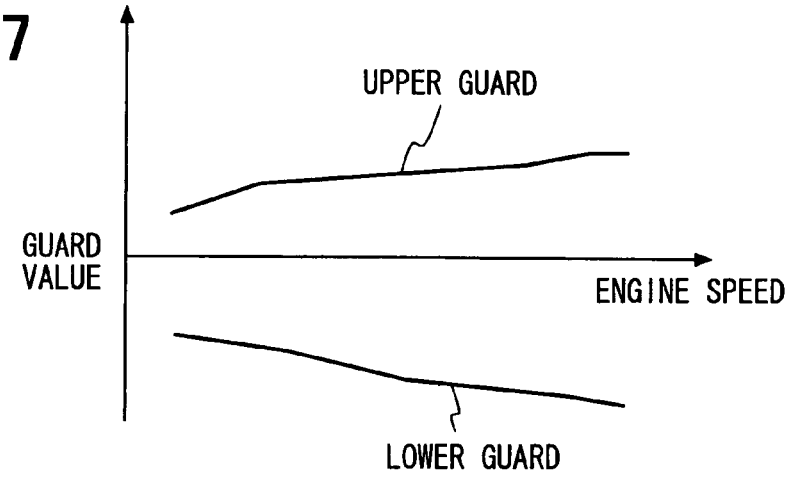
FIG. 7 is a chart schematically showing an upper and lower guard value map.

When the answer is Yes in step 104, the procedure proceeds to step 105 in which an upper guard value and a lower guard value are computed based on the instant engine speed according to an upper-lower guard value map shown in FIG. 7. As shown in FIG. 7, as the engine speed increases, absolute values of the upper guard value and the lower guard value increase. The upper guard value and the lower guard value may be established according to the engine speed and the camshaft phase deviation. For simplification of data processing, the guard values may be alternatively established as predetermined constant values.

Then, the procedure proceeds to step 106 in which the motor speed F/B amount computed in step 102 is guard-processed by using of the upper and lower guard values computed in step 105. That is, in a case that the motor speed F/B correction amount is greater than the upper guard value, the motor speed F/B correction amount is brought to the upper guard value. In a case that the motor speed F/B correction amount is less than the lower guard value, the motor speed F/B correction amount is brought to the lower guard value. In a case that the motor speed F/B correction amount is within a range between the upper guard value and the lower guard value, the motor speed F/B correction amount is not changed. In steps 105, and 106, electric current applied to the motor is restricted.

Then, the procedure proceeds to step 107 in which the target motor speed is computed by using of the guard-processed rotational speed F/B correction amount.

Target motor speed (TMS)=Base target motor speed (BTMS)+Guard-processed motor speed *F/B* correction amount (G-MSFBC)

The ECU 30 outputs the signal indicative of the target motor speed calculated by the above process toward the EDU 31.

[Motor Current Estimation Program]

The motor current estimation program shown in FIG. 5 is a subroutine performed in step 103 of FIG. 4. In step 201, it is determined whether a motor current restricting process (motor speed F/B correction amount guard) is executed. In the motor current restricting process, a holding current (motor current based on a holding duty) is set as an estimated motor current in step 202.

When the answer is No, the procedure proceeds to step 203 in which it is determined whether a most retard control is executed. In the most retard control, the camshaft phase is fixed at the most retarded phase (reference phase). When the answer is Yes in step 203, the procedure proceeds to step 204 in which an indication current is set as an estimation motor current. The indication current is a motor current which is determined based on an indication duty at the most retard control.

Meanwhile, when the answer is No in step 203, the procedure proceeds to step 205 in which the deviation between the target motor speed and the actual motor speed is multiplied by a F/B gain G to obtain the motor speed F/B amount.

Motor speed *F/B* amount=*G*×(Target motor speed−Actual motor speed)

Then, the procedure proceeds to step 206 in which the motor speed F/B amount computed in step 205 is added to the target motor speed to obtain a motor control mount.

Motor control amount=Target motor speed+Motor speed *F/B* amount

Figure 8:
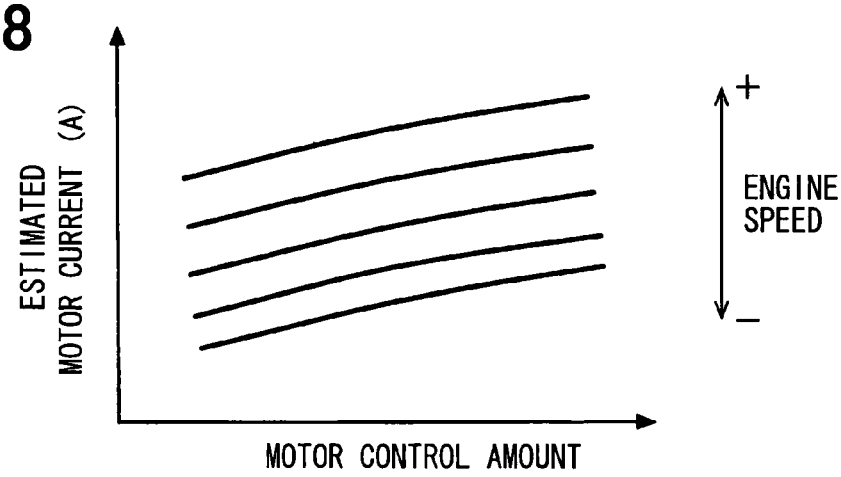
FIG. 8 is a chart schematically showing an estimated motor current map.

Then, the procedure proceeds to step 207 in which the instant motor control amount and the estimated motor current according to the engine speed are computed with reference to an estimated motor current map shown in FIG. 8. In the estimated motor current map of FIG. 8, as the motor control amount increases, the estimated motor current increases, and as the engine speed increases, the estimated motor current increases. Besides, the estimated motor current may be computed only based on the motor control amount.

Besides, the estimated motor current may be computed based on a map which has the target motor speed, the actual motor speed, and the engine speed as parameters. Alternatively, the estimated motor current may be computed based on a map which has the target motor speed and the actual motor speed as parameters. The estimated motor current may be computed by taking into consideration the parameters (for example, battery voltage, camshaft phase deviation) other than the above.

Figure 9:
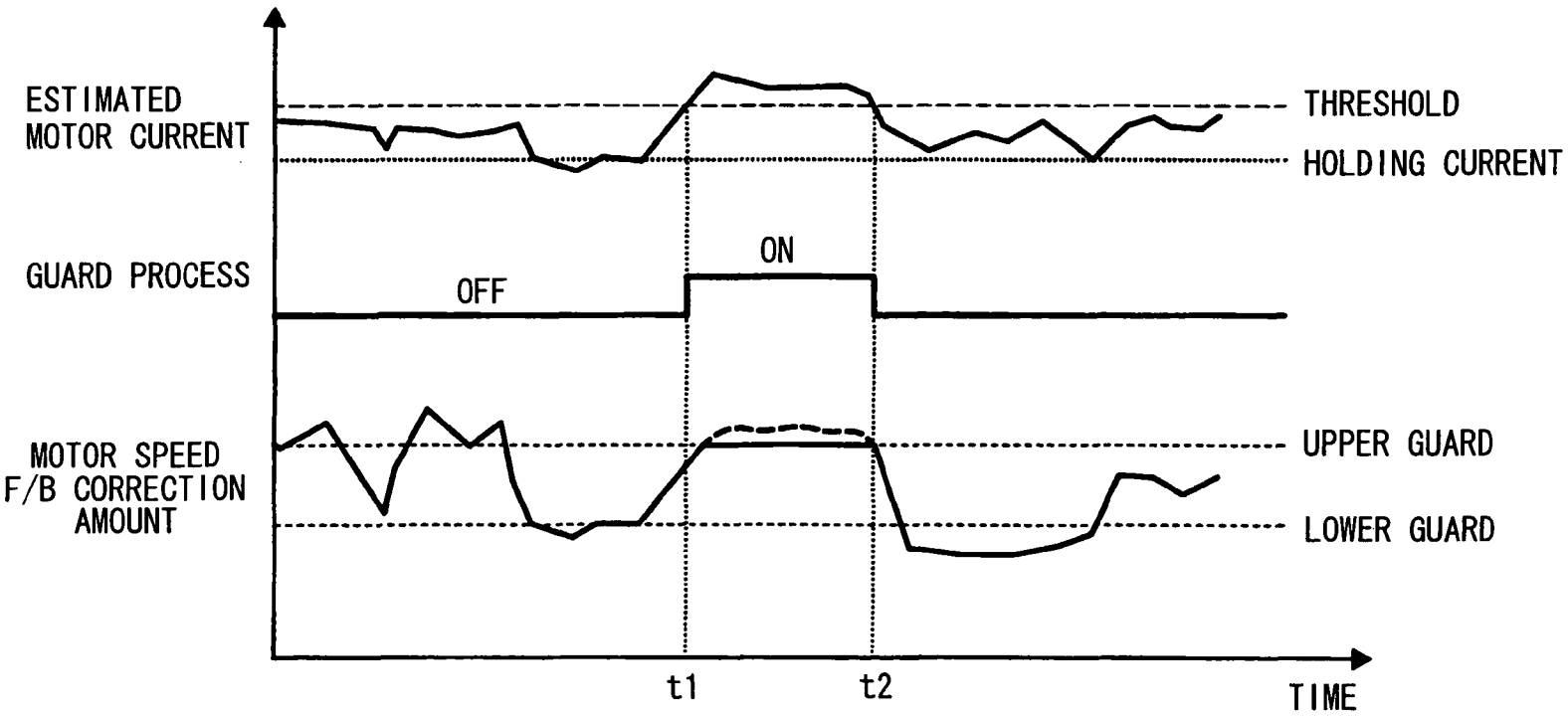
FIG. 9 is a time chart for explaining a control of the first embodiment.

A control process of the first embodiment will be described hereinafter based on time charts shown in FIG. 9.

Since the estimated motor current is less than a threshold equivalent to the heat generation limiting current value before time t1, the guard process to motor speed F/B amount is not performed. Then, when estimated motor current exceeds the threshold at time t1, the guard process to the motor speed F/B amount is started. The motor speed F/B amount is restricted with the upper limit guard value and the lower limit guard value. Thereby, the variation (motor speed F/B amount) in target motor speed outputted to EDU 31 is restricted, and the motor current is restricted.

Then, at time t2, when the estimated motor current falls to less than the threshold, the guard process to motor speed F/B amount is canceled. In this state, the motor speed F/B amount is not limited within the range between the upper limit guard value and the lower limit guard value, it may be established outside the range. The actual motor speed (actual camshaft phase) is changed according to a change in target motor speed (target camshaft phase) with high response.

According to the first embodiment, the motor current is estimated based on the target motor speed, the actual motor speed, and the engine speed. When the estimated motor current exceeds the predetermined value (threshold) equivalent to the heat limiting current value, the variation (motor speed F/B amount) in the target motor speed outputted to the EDU 31 from the ECU 30 is restricted, and the motor current is also restricted. Hence, the heat value of motor 26 may not exceed the heat generation limit, and it can be prevented that the coil temperature of motor 26 exceeds the allowable temperature range. The durability deterioration and failure of motor 26 can be prevented. In this case, when the motor current is restricted, speed of response only becomes slow and the variable valve timing control can be performed to reduce the deviation of the target camshaft phase and the actual camshaft phase.

Second Embodiment

Figure 10:
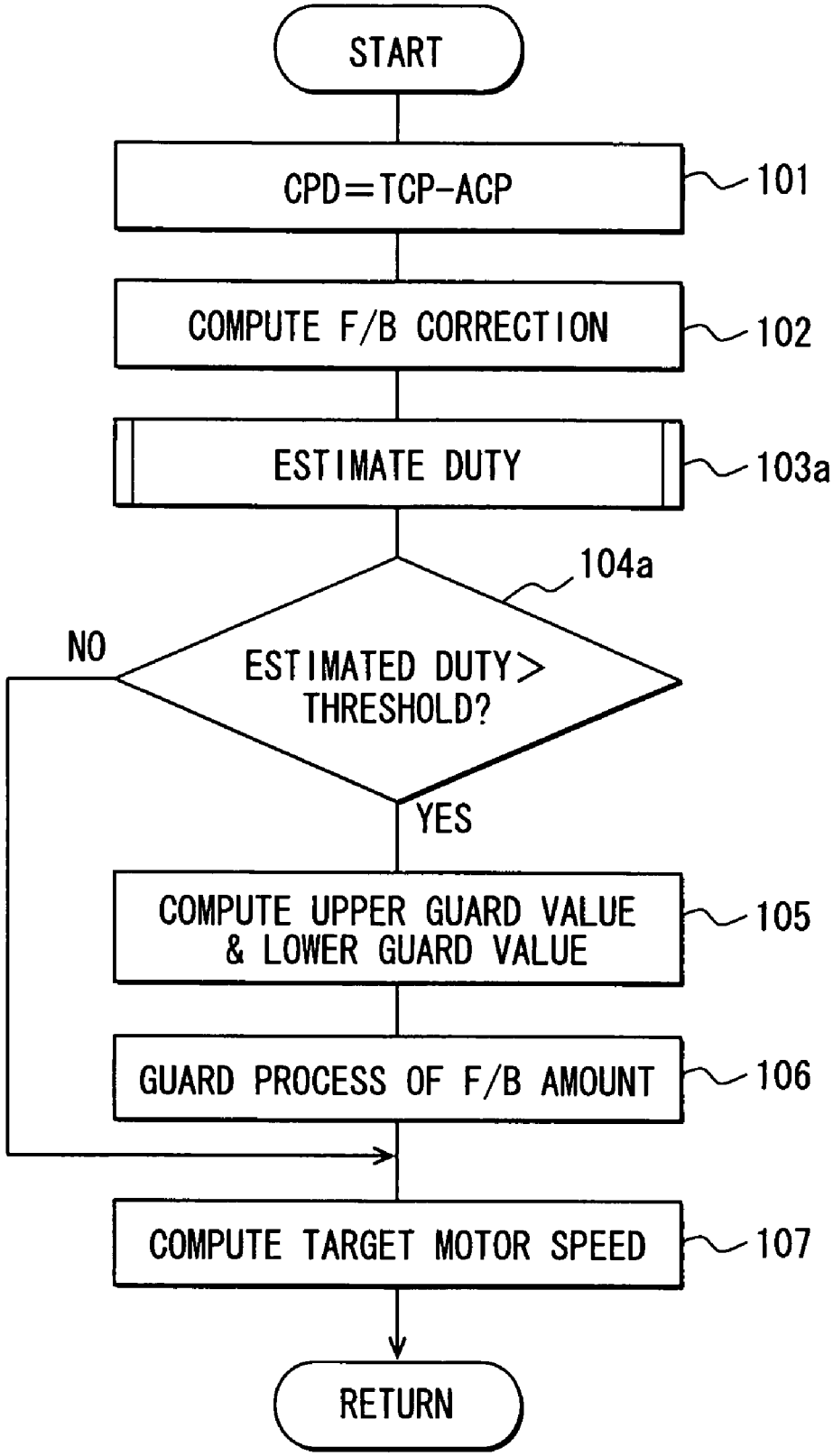
FIG. 10 is a flow chart showing a processing of the target motor speed operation program according to a second embodiment.
Figure 11:
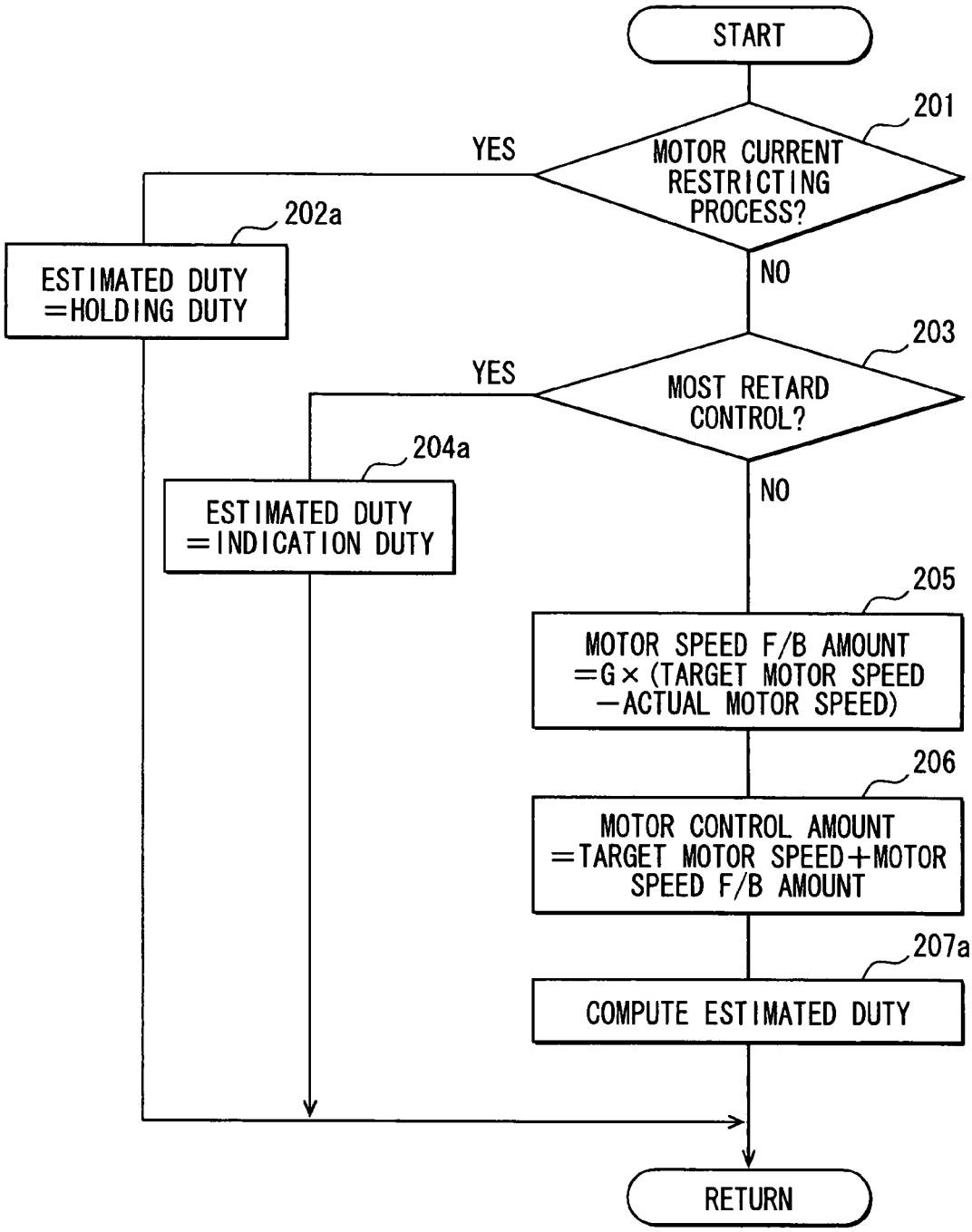
FIG. 11 is a flow chart showing a processing of a duty estimation program according to the second embodiment.

In a second embodiment shown in FIGS. 10 and 11, the duty of the voltage applied to motor 26 is estimated as the information of the motor current, and when the estimated duty exceeds the predetermined value, the variation (motor speed F/B correction amount) in the target motor speed which is outputted to the EDU 31 from the ECU 30 is restricted, whereby the motor current is restricted. Hereafter, the processing of each program shown in FIGS. 10 and 11 is explained.

In the target motor speed computation program shown in FIG. 10, processings except steps 103*a* and 104*a* are the same as those shown in FIG. 4

After computing the camshaft phase deviation and the rotational speed F/B correction amount in steps 101 and 102, the procedure proceeds to step 103*a* in which a duty estimation program shown in FIG. 11 is executed. In step 103*a*, a duty ratio is estimated based on the instant target motor speed and the instant actual motor speed. Then, the procedure proceeds to step 104*a* in which it is determined whether the estimated duty ratio exceeds a specified value equivalent to the heat generation limiting duty ratio. When the answer is No in step 104*a*, the procedure proceeds to step 107 in which the target motor speed is computed by using of the motor speed F/B correction amount.

When the answer is Yes in step 104*a*, the procedure proceeds to step 105 in which an upper guard value and a lower guard value are computed based on the instant engine speed according to a upper-lower guard value map shown in FIG. 7. Then, the procedure proceeds to step 106 in which the motor speed F/B amount computed in step 102 is guard-processed by using of the upper and lower guard values computed in step 105. Then, the procedure proceeds to step 107 in which the target motor speed is computed by using of the guard processed rotational speed F/B correction amount.

In the duty ratio estimation program shown in FIG. 11, processings except steps 202*a*, 204*a*, and 207*a* are the same as those of motor current estimation program shown in FIG. 4. When it is determined that the motor current restricting process is executing in step 201, the procedure proceeds to step 202*a* in which the holding duty is set as an estimated duty.

When the answer is No in step 201 and the answer is Yes in step 203, the procedure proceeds to step 204*a* in which an indication duty of the most retarded control is set as the estimated duty.

When the answers are No in steps 201 and 203, the procedure proceeds to steps 205 and 206 to compute the motor control amount. Then, the procedure proceeds to step 207*a* in which an estimated duty ratio according to the motor control amount is computed based on a map.

In the second embodiment, the duty of the voltage applied to motor 26 is estimated as the information of the motor current, and when the estimated duty exceeds the predetermined value, the variation (motor speed F/B correction amount) in the target motor speed which is outputted to the EDU 31 from the ECU 30 is restricted, whereby the motor current is restricted. Therefore, the same advantage as first embodiment can be obtained.

Third Embodiment

Figure 12:
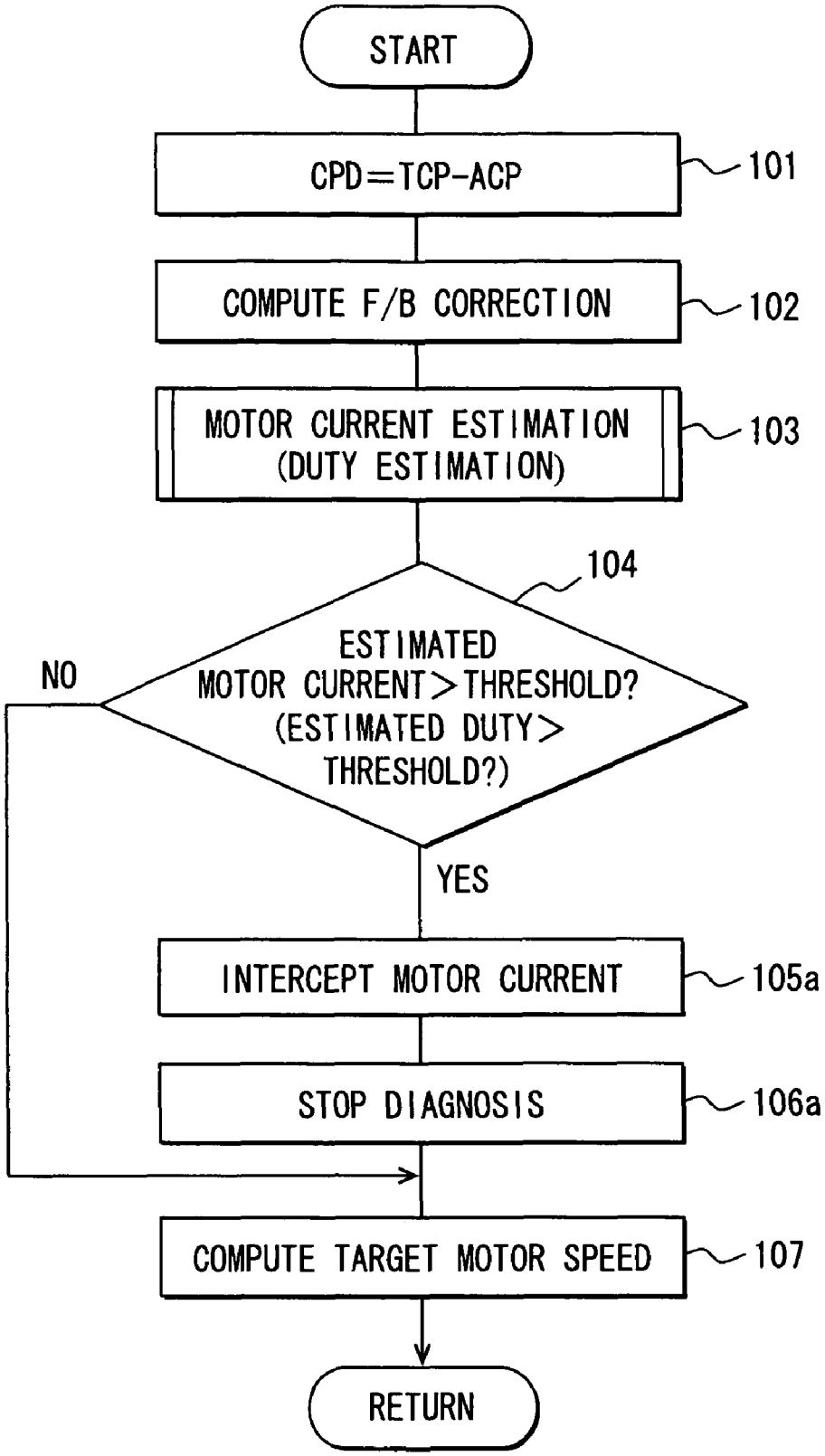
FIG. 12 is a flow chart showing a processing of the target motor speed operation program according to a third embodiment.

In first and second embodiments, when the estimated motor current (duty) exceeded the specified value, the motor current is restricted. In a third embodiment shown in FIG. 12, when the estimated motor current (duty) exceeds the specified value, the motor current is intercepted in step 105*a* and the diagnosis of the variable valve timing controller 18 is stopped in step 106*a*. The other processings are the same as the first embodiment.

According to the third embodiment, when the estimated current (duty) exceeds the specified value, the motor current is intercepted to decrease coil temperature of the motor 26. Furthermore, since the diagnosis of variable valve timing controller 18 is stopped, it can prevent an erroneous decision that the state where the variable valve timing control is compulsorily stopped by interception of the motor current is determined as malfunction.

Besides, the present invention is not limited to the variable valve timing controller of the intake valve, but may be applied to the variable valve timing controller of the exhaust valve. Furthermore, the phase variable mechanism of the variable valve timing device 18 is not limited to the planetary gear mechanism. Other mechanisms are employable when the valve timing is changed by varying the rotational speed of the motor relative to the rotational speed of the camshaft.

What is claimed is:

1. A variable valve timing controller adjusting a valve timing of an intake valve and/or an exhaust valve by varying a speed of an electric motor relative to a rotational speed of a camshaft in such a manner as to vary a camshaft phase representing a rotational phase of the camshaft relative to a crankshaft of an internal combustion engine, the variable valve timing controller comprising:

a target motor speed computing device configured to compute a target motor speed based on a rotation speed of the internal combustion engine and a deviation between a target camshaft phase and an actual camshaft phase;

a motor drive controller configured to feedback control a motor current representing a driving current of the motor in such a manner as to decrease a deviation between the target motor speed and an actual motor speed;

a motor current estimating device configured to estimate the motor current based on at least the target motor speed and the actual motor speed; and a motor current restricting device configured to restrict the motor current when the motor current estimated by the motor current estimating device exceeds a specified value.

2. A variable valve timing controller according to claim 1, wherein the motor current estimating device estimates the motor current based on at least the target motor speed, the actual motor speed, and the rotation speed of the internal combustion engine.

3. A variable valve timing controller according to claim 1, wherein the motor current restricting device restricts the motor current by restricting a variation in target motor speed when the estimated motor current exceeds the specified value.

4. A variable valve timing controller according to claim 3, wherein the target motor speed computing device computes a motor speed correction amount based on the rotation speed of the internal combustion engine and the deviation between the target camshaft phase and the actual camshaft phase, and computes the target motor speed by correcting a base target motor speed, which corresponds to a rotation speed of the camshaft, and the motor current restricting device restricts the variation in target motor speed by restricting the motor speed correction amount when the estimated motor current exceeds the predetermined value.

5. A variable valve timing controller according to claim 4, wherein the motor current restricting in device varies a restricting range of the motor speed correction amount according to the rotation speed of the internal combustion engine.

6. A variable valve timing controller according to claim 1, wherein the motor drive controller adjusts a duty ratio of voltage applied to the motor in order to control the motor current, the motor current estimating device estimates the duty ratio of voltage applied to the motor as information of the motor current, and the motor current restricting device restricts the motor current when the duty ratio estimated by the motor current estimating device exceeds the specified value.

7. A variable valve timing controller adjusting a valve timing of an intake valve and/or an exhaust valve by varying a speed of an electric motor relative to a rotational speed of a camshaft in such a manner as to vary a camshaft phase representing a rotational phase of the camshaft relative to a crankshaft of an internal combustion engine, the variable valve timing controller comprising:

a target motor speed computing device configured to compute a target motor speed based on a rotation speed of the internal combustion engine and a deviation between a target camshaft phase and an actual camshaft phase;

a motor drive controller configured to feedback control a motor current representing a driving current of the motor in such a manner as to decrease a deviation between the target motor speed and an actual motor speed;

a motor current estimating device configured to estimate the motor current based on at least the target motor speed and the actual motor speed;

a motor current intercepting device configured to intercept the motor current when the motor current estimated by the motor current estimating device exceeds a specified value.

8. A method of adjusting a variable valve timing of an intake valve and/or an exhaust valve by varying a speed of an electric motor relative to a rotational speed of a camshaft in such a manner as to vary a camshaft phase representing a rotational phase of the camshaft relative to a crankshaft of an internal combustion engine, the method comprising:

computing a target motor speed based on a rotation speed of the internal combustion engine and a deviation between a target camshaft phase and an actual camshaft phase;

for feedback controlling a motor current representing a driving current of the motor in such a manner as to decrease a deviation between the target motor speed and an actual motor speed;

estimating the motor current based on at least the target motor speed and the actual motor speed; and restricting the motor current when the estimated motor current exceeds a specified value.

9. A method according to claim 8, wherein the motor current is estimated based on at least the target motor speed, the actual motor speed, and the rotation speed of the internal combustion engine.

10. A method according to claim 8, wherein the motor current is restricted by restricting a variation in target motor speed when the estimated motor current exceeds the specified value.

11. A method according to claim 10, wherein a motor speed correction amount is computed based on the rotation speed of the internal combustion engine and the deviation between the target camshaft phase and the actual camshaft phase, and the target motor speed is computed by correcting a base target motor speed, which corresponds to a rotation speed of the camshaft, and the variation in target motor speed is restricted by restricting the motor speed correction amount when the estimated motor current exceeds the predetermined value.

12. A method according to claim 11, wherein a restricting range of the motor speed correction amount is varied according to the rotation speed of the internal combustion engine.

13. A method according to claim 8, wherein a duty ratio of voltage applied to the motor is adjusted in order to control the motor current, the duty ratio of voltage applied to the motor is estimated as information of the motor current, and the motor current is restricted when the estimated duty ratio exceeds the specified value.

14. A method of adjusting a variable valve timing of an intake valve and/or an exhaust valve by varying a speed of an electric motor relative to a rotational speed of a camshaft in such a manner as to vary a camshaft phase representing a rotational phase of the camshaft relative to a crankshaft of an internal combustion engine, the method comprising:

computing a target motor speed based on a rotation speed of the internal combustion engine and a deviation between a target camshaft phase and an actual camshaft phase;

feedback controlling a motor current representing a driving current of the motor in such a manner as to decrease a deviation between the target motor speed and an actual motor speed;

estimating the motor current based on at least the target motor speed and the actual motor speed;

intercepting the motor current when the estimated motor current exceeds a specified value.

* * * * *